United States Patent [19]

Eley

[11] 4,427,860

[45] Jan. 24, 1984

[54] OIL-INSULATED SWITCH

[75] Inventor: Edgar R. Eley, Athens, Ga.

[73] Assignee: Westinghouse Electric Corp., Pittsburgh, Pa.

[21] Appl. No.: 350,526

[22] Filed: Feb. 19, 1982

[51] Int. Cl.[3] ..... H01H 33/88

[52] U.S. Cl. ..... 200/150 G; 200/148 A

[58] Field of Search ..... 200/148 A, 150 G

[56] References Cited

U.S. PATENT DOCUMENTS 2,459,599 1/1949 Strom ..... 200/150 G

FOREIGN PATENT DOCUMENTS 653377 11/1937 Fed. Rep. of Germany ... 200/150 G
1145687 3/1963 Fed. Rep. of Germany ... 200/150 G
651781 1/1963 Italy ..... 200/150 G

*Primary Examiner*—Robert S. Macon
*Attorney, Agent, or Firm*—L. P. Johns

[57] ABSTRACT

An oil-immersed switch characterized by movable contacts mounted on a piston for movement in a cylinder for forcing oil or dielectric fluid through stationary contacts for extinguishing any arc during opening and closing of the contacts, and whereby any arcing generated during closure of the contacts generates gas pressure which acts upon a piston for aiding enclosure of the contacts.

5 Claims, 10 Drawing Figures

OIL-INSULATED SWITCH

BACKGROUND OF THE INVENTION

1. Field of the Invention

This invention relates to a switch for use in high-voltage electrical distribution circuits, and more particularly, it pertains to a closed container in which the switch is completely submerged in insulating oil or dielectric fluid.

2. Description of the Prior Art

A puffer-type circuit breaker is one in which an arc-extinguishing gas is compressed in conjunction with a breaking operation to extinguish an arc generated between contactors. Patents disclosing puffer-type circuit breakers include U.S. Pat. Nos. 3,839,613 and 4,139,751. Because of their inherent nature most circuit breakers of the puffer type are inherently devoid of means for facilitating closing of the circuits on system fault currents.

SUMMARY OF THE INVENTION

In accordance with this invention it has been found that a circuit breaker may be provided which comprises a cylindrical switch body within which a plunger is disposed for carrying movable contacts between open and closed positions with respect to stationary contacts and which body is submerged within a liquid dielectric; means for axially operating the plunger between open and closed positions of the contacts, the stationary contacts having an axial opening therein which communicates with a cavity defined by the switch body in the plunger, the cavity being reduced in volume when the plunger is operated to separate the contacts and causing the liquid dielectric to be forced through the hollow stationary contacts to aid arc extinction, the cavity being increased in volume when the plunger is operated to close the contacts and causing liquid dielectric to flow into the cavity through the hollow stationary contacts, and the movable contacts being urged to closed positions by the pressure of a gas on the plunger as a result of an arc incurred when the contacts are closed in a faulted circuit.

The advantage of the device of this invention is that it is mounted within a closed container and completely submerged in a dielectric liquid for the purpose of extinguishing an arc incurred during opening and during closing and latching.

DESCRIPTION OF THE PREFERRED EMBODIMENT

Figure 1:
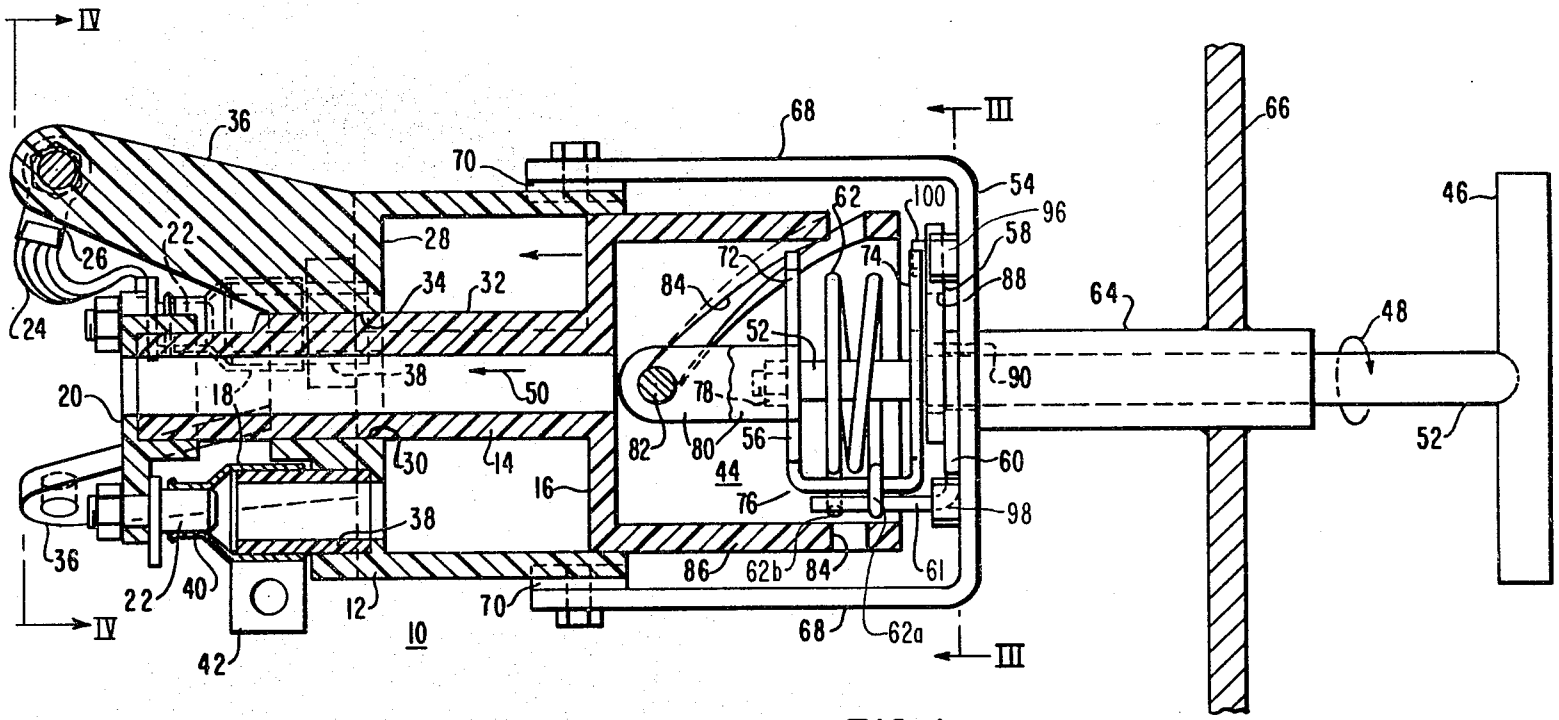
FIG. 1 is a vertical sectional view of a circuit breaker of the present invention shown in the closed condition.

In FIG. 1 a cylindrical switch body is generally indicated at 10 and it comprises a switch body 12, a plunger 14 extending from a piston 16, and stationary contacts 18.

The switch 10 also comprises a contact carrier 20 carrying movable contacts 22. From each movable contact 22 a shunt conductor 24 extends to a terminal 26.

The switch body 12, being cylindrical includes an open end through which the piston 16 extends and a closed end wall 28 having an aperture 30 through which the plunger 14 extends. The plunger comprises a longitudinal rib 32 which extends through a notch 34 in the opening 30, whereby the plunger 14 moves longitudinally without rotation in the opening 30. In addition, the switch body 12 comprises three similar arms 36 extending from the closed end wall 28 for supporting the terminals 26 of each of the three-cycle circuits.

Each cylindrical stationary contact 18 is mounted on a tube 38 of dielectric material, whereby communication through the tube is provided between the interior of the switch body 12 and a reduced neck portion 40 of each stationary contact 18 in which portions the several movable contacts 22 are seated when the contacts are closed. A strap conductor 42 is attached to each stationary contact 18.

Figure 2:
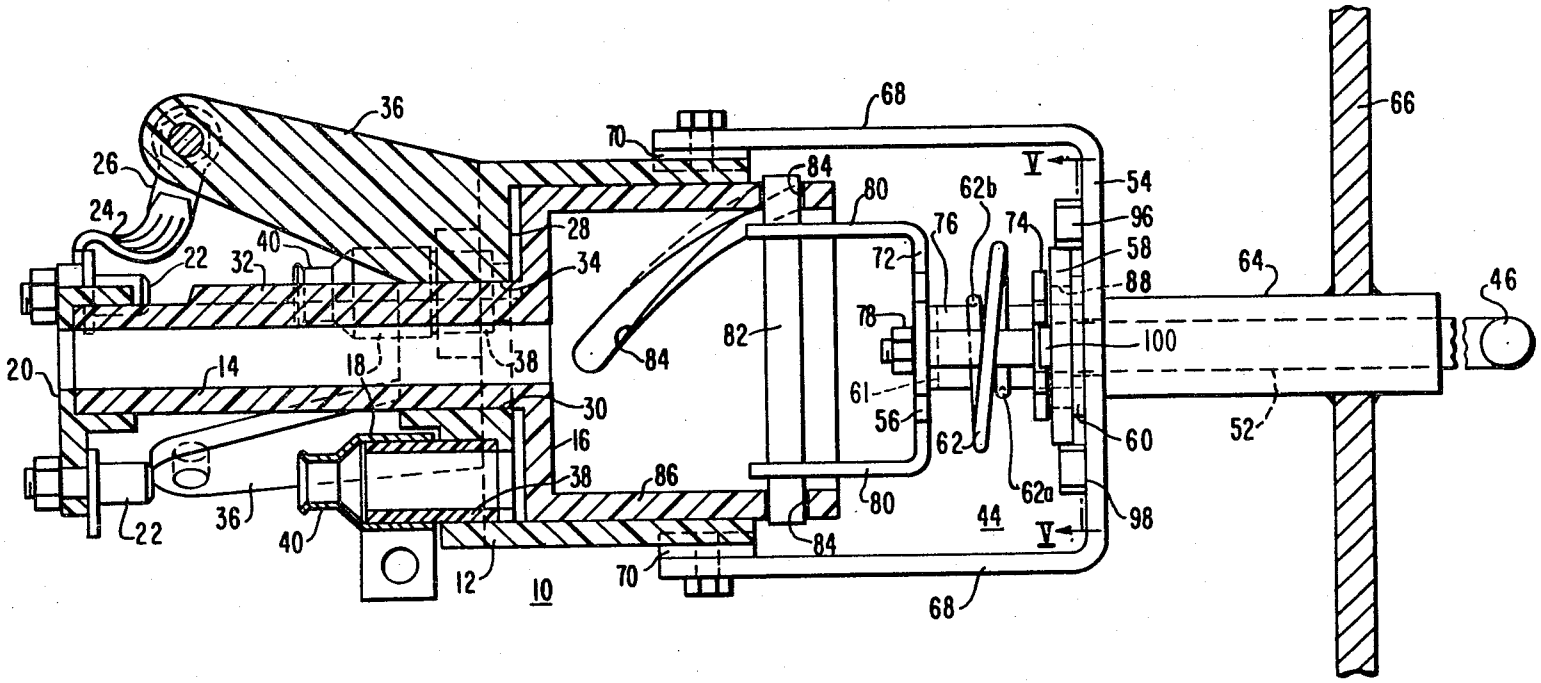
FIG. 2 is a vertical sectional view showing the circuit breaker in the open condition.

The switch 10 also comprises an operating mechanism 44 by which the piston 16 and plunger 14 are moved longitudinally through the switch body 12 for opening and closing the circuits (FIGS. 1, 2). Specifically, when a handle 46 (FIG. 1) is rotated in the direction of the arrow 48, the plunger 14 moves in the direction of the arrow 50 to disconnect the movable contacts 22 from the stationary contacts 40 (FIG. 2). Conversely, when the handle 46 is moved in the opposite direction, the contacts 22 move to the closed condition with the stationary contacts 40 (FIG. 1) closed.

Figure 6:
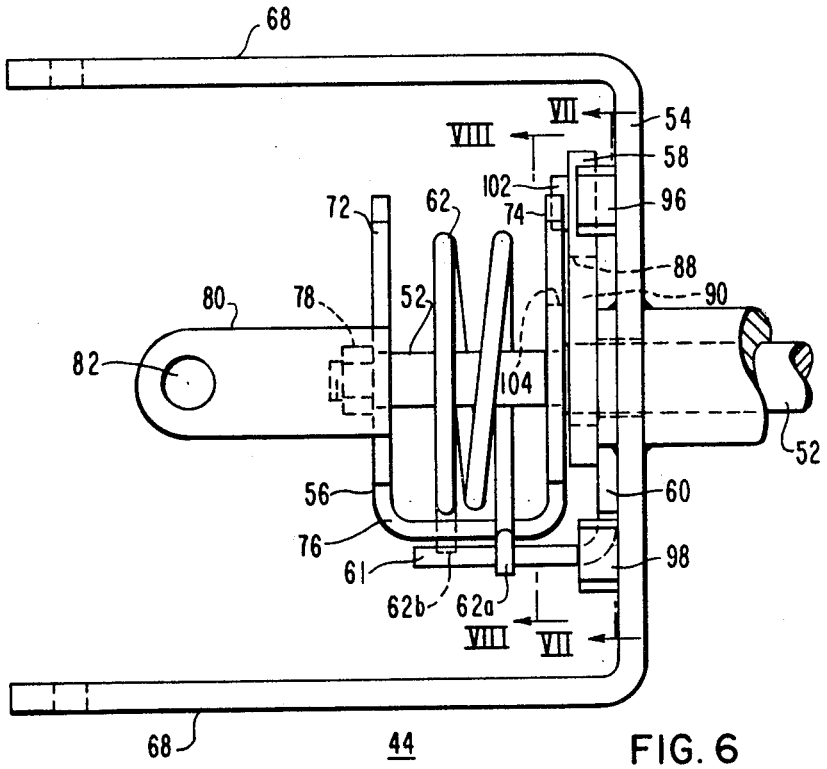
FIG. 6 is an enlarged elevational view of the operating mechanism.
Figure 7:
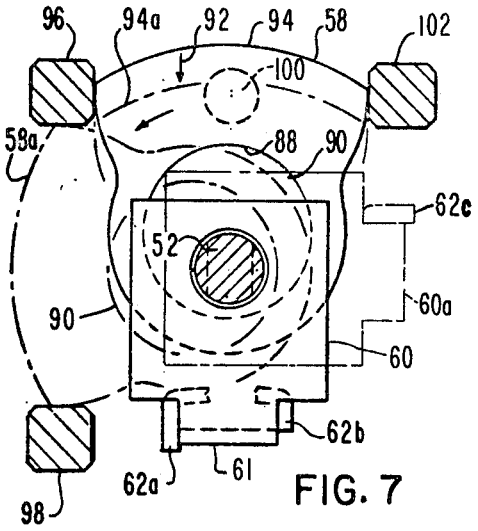
FIG. 7 is a vertical sectional view taken on the line VII—VII of FIG. 6.
Figure 8:
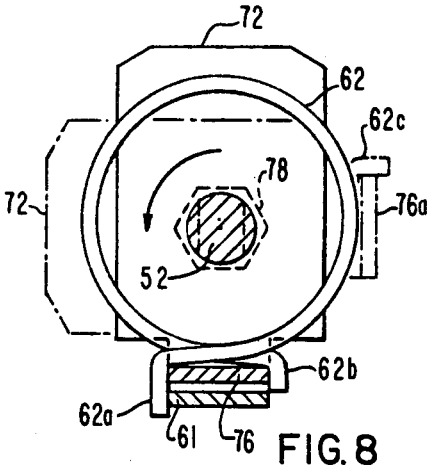
FIG. 8 is a vertical sectional view taken on the line VIII—VIII of FIG. 6.

The operating mechanism 44 is comprised of a rotatable shaft 52, a mounting frame 54, an adapter 56, a stop plate 58, an arm 60, and spring means such as a spring 62. The arm 60 comprises an arm member 61 (FIG. 6). A shaft 52, on which the handle 46 is mounted, is generally mounted in a sleeve 64 which extends through a wall 66 of a tank containing electrical equipment, such as a transformer, which is immersed in a cooling oil or dielectric fluid (not shown). The frame 54 is mounted on the inner end of the sleeve 64 and comprises a pair of similar arms 68, the extremities of which are fixedly mounted on diametrically opposite sides of the switch body 12 at 70. The sleeve 64, being secured to the wall 66 in a fluid-tight manner, serves as a fluid seal between the sleeve and the shaft 52, and supports the switch 10 by the frame 54.

The operating mechanism 44 is shown more particularly in FIGS. 5, 6, 7, 8, 9. The adapter 56 is rotatably mounted on the shaft 52 and comprises a channel member having U-legs 72, 74 and bight portion 76 and is retained by a nut 78. The U-leg 72 comprises a pair of similar arms 80 (FIG. 2) which support a pin 82. Opposite end portions of the pin 82 are disposed in similar arcuate grooves 84 in diametrically opposite sides of a cylindrical portion 86 of the piston 16. As set forth below rotation of the operating mechanism 44 is translated into linear motion of the plunger-piston assembly through the opening 30 in the end wall 28 of the switch body 12, thereby moving the movable contacts 22 between open and closed conditions with respect to the stationary contacts 18. More specifically, as the operating mechanism 44 is rotated, the end portions of the pin 82 act upon the cam surfaces of the arcuate grooves 84 for moving the piston 16 between the closed and opened positions thereof (FIGS. 1, 2).

The stop plate 58 comprises a cam hole 88 (FIGS. 2 and 7) in which a cam 90 is disposed. The cam 90 and the arm 60 are secured on the shaft 52. When the shaft 52 is rotated through a 90° arc, the cam 90 retracts the stop plate 58 in the direction of the arrow 92 (FIG. 7) to a broken line position 94*a* where it clears a stop 96, causing the stop plate 58 to turn counterclockwise to the position 58*a* at a stop 98 and the arm 60 rotates to broken line position 60*a*. Spring end 62*a* is held stationary by bight portion 76 (FIG. 8) of adapter 56. Spring end 62*b* is rotated to broken line position 62*c*, and the stop plate 58 clears the stop pin 96, whereby the stop plate and adapter 56 are rotated by the spring 62 to position 58*a* (FIG. 7), where they are prevented by stop pin 98 from further rotation. The rotation of the adapter 56 with pin 82 moving in grooves 84 of cylinder 86 causes the plunger to move downward, thus opening the contacts. To close the contacts the handle 46 (FIG. 2) is manually rotated in the opposite direction causing the stop plate 58 to rotate to a stop pin 102 thus reversing the above process. The pins 96, 98, 102 are mounted on the frame 54.

Figure 3:
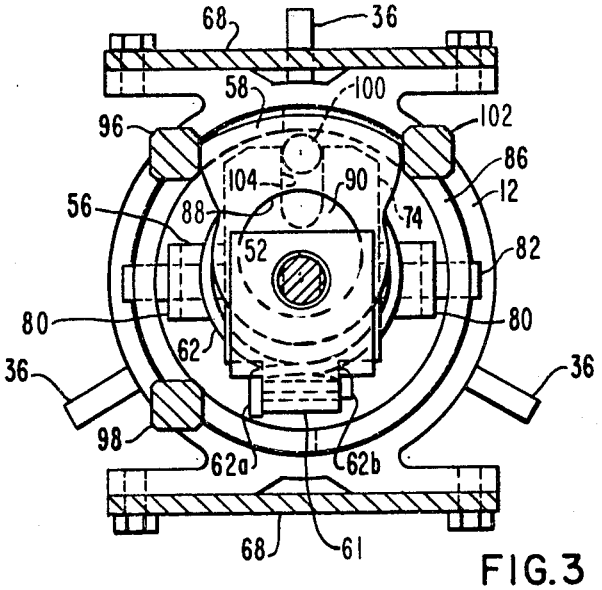
FIG. 3 is an end view taken on the line III—III of FIG. 1.
Figure 4:
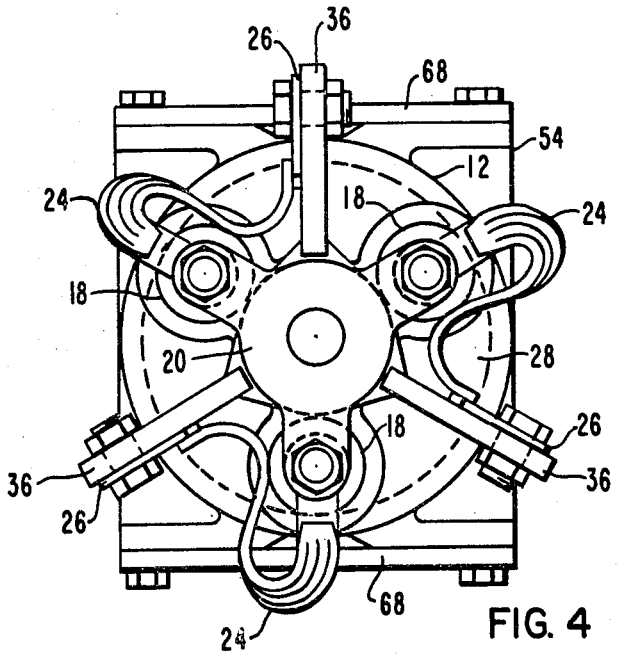
FIG. 4 is an end view taken on the line IV—IV of FIG. 1.
Figure 5:
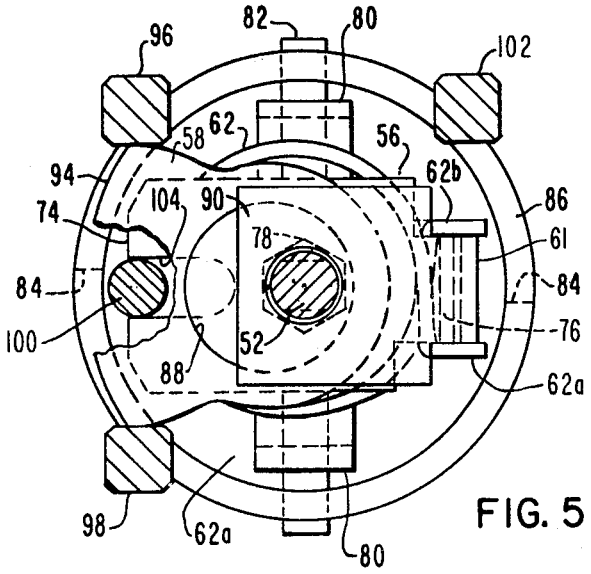
FIG. 5 is an end view of an operating mechanism of the device taken on the line V—V of FIG. 2.

The stop plate 58 comprises a pin 100 (FIG. 5), extending from the side of the plate adjacent to the U-leg 74 which leg includes a slot 104 (FIGS. 3, 9) in which the pin is disposed. As as the cam 90 retracts the stop plate 58 in the direction of the arrow 92 (FIG. 7), the pin 100, moving in the slot 104, maintains the adapter 56 in position until the surface of the plate reaches the position 94*a* and clears the stop 96. The assembly of the stop plate and adapter 56 is then free to rotate, whereupon the pin 82 moves the piston 16 within the switch body 12.

Inasmuch as the switch 10 is immersed in a cooling oil or dielectric liquid, such as in a transformer tank, the fluid occupies a chamber 106 defined by the switch body 12 and the piston 16. When the operating mechanism 14 rotates to open the contacts 18, 22, the piston 16 forces oil through the tubular contacts 38. The oil flows between the opening contacts to cool an arc and thereby aid in fast interruption of the arc. Moreover, inasmuch as fresh oil is flowing through the opening contacts any ionized gases are washed away, ensuring extremely fast insulation recovery.

In accordance with this invention the cylinder and piston arrangement facilitate in closing the contacts, when fault currents exist. If the switch is closed on a faulted circuit, a resulting high-current arc rapidly generates high volumes of gases within the oil. Pressure developed by the gas develops a force through the tubular stationary contacts 18 and against the piston 16 in the confined volume of the switch body 12 which tends to force the contacts to the closed position. This force on the piston cooperates with the force of the spring 62 in closing the contacts.

Figure 10:
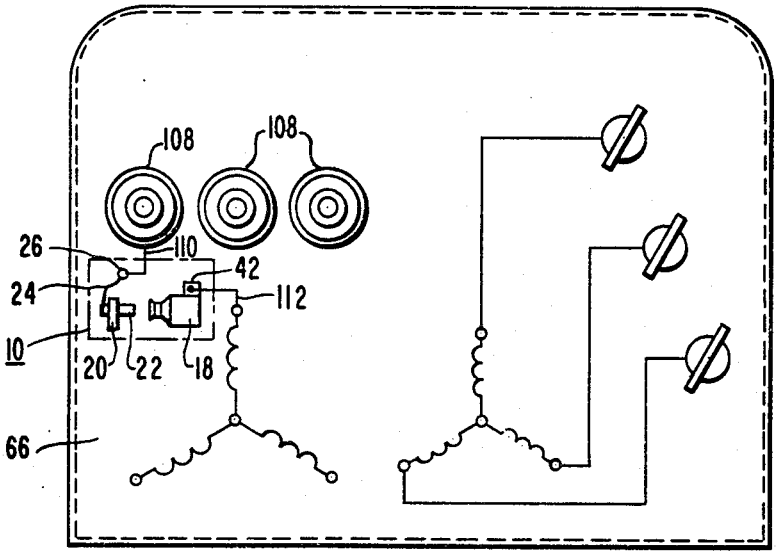
FIG. 10 is a schematic view of a circuit through a switch and transformer.
Figure 9:
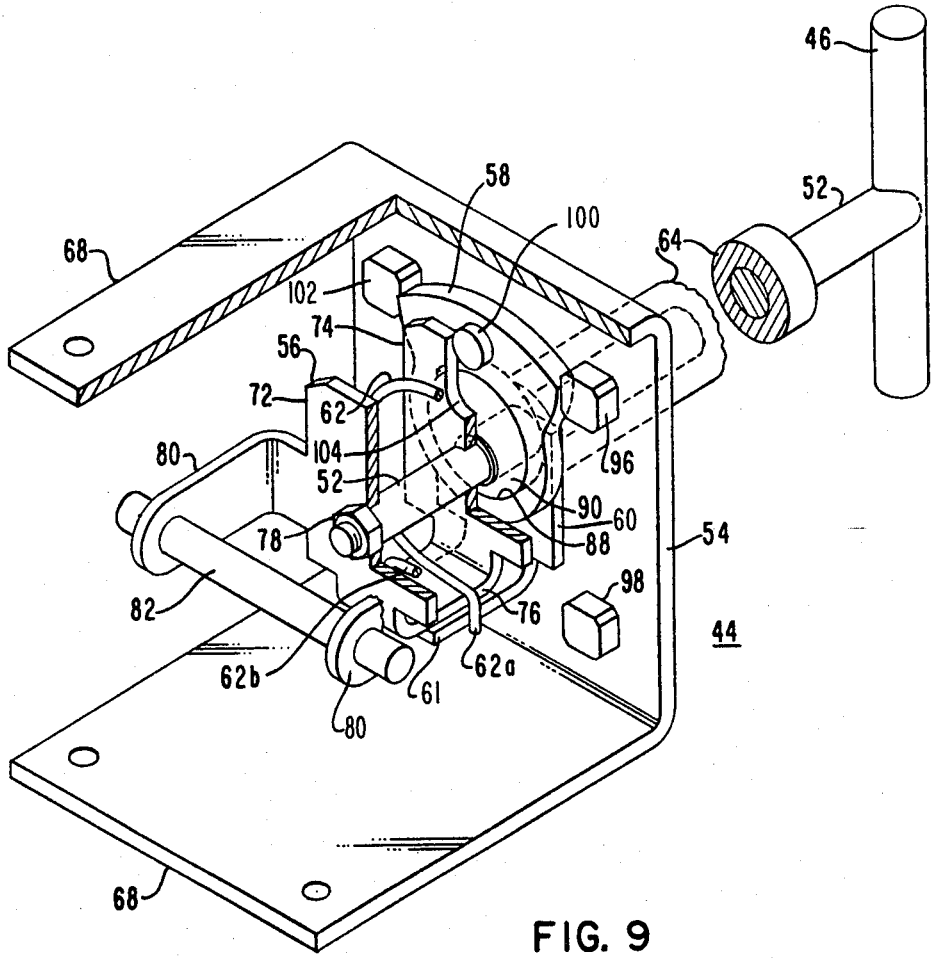
FIG. 9 is an isometric view of the operating mechanism.

A circuit through the unit is shown in FIG. 10 in which a plurality, such as three, bushings 108 extend from the top of a transformer tank wall 66 the circuit is through a conductor 110 to the terminal 26, cable 24, movable contact 22, stationary contact 18, strap conductor 42, and conductor 112 to one leg of a transformer, such as a Y, three-phase system.

In conclusion, the device of this invention provides for a switch which is capable of closing and latching on its system fault currents and interrupting system load currents. Insulating cooling oil is moved between the contacts both in the opening and closing operations. These two features enable construction of an oil-insulated switch of high-current interruption ratings and high-fault, close-in ratings in very small sizes.

What is claimed is:

1. A circuit breaker comprising (a) a cylindrical switch body having hollow, stationary contacts, a plunger disposed within said switch body which carries movable contacts, said switch body and plunger cooperatively defining a cavity filled with a liquid dielectric;

(b) means for axially operating said plunger between open and closed positions of said movable and stationary contacts;

(c) said stationary contacts having an axial opening therein which communicates with the cavity defined by said switch body and plunger;

(d) said cavity being reduced in volume when the plunger is operated to separate the contacts, causing the liquid dielectric to be forced through the hollow stationary contacts to aid arc extinction; and (e) said cavity being increased in volume when the plunger is operated to close the contacts, causing liquid dielectric to flow into the cavity through the hollow stationary contacts.

2. The switch of claim 1 in which the means comprises means for translating rotary motion to rectilinear motion.

3. The switch of claim 2 in which the means for translating rotary motion includes a rotating, spring-loaded, operating mechanism.

4. The switch of claim 1 in which at step (e) the movable contacts are urged to closed positions by the pressure of gas on plunger as the result of an arc incurred when the contacts are closed on a faulted circuit.

5. The switch of claim 4 in which the switch is immersed in a dielectric liquid in which the gas pressure moves the plunger in the direction of contact closure.

* * * * *